United States Patent [19]

Gazda

[11] 3,990,511

[45] Nov. 9, 1976

[54] WELL SAFETY VALVE SYSTEM

[75] Inventor: Imre I. Gazda, Saginaw, Tex.

[73] Assignee: Otis Engineering Corporation, Dallas, Tex.

[22] Filed: Jan. 20, 1975

[21] Appl. No.: 542,117

Related U.S. Application Data

[62] Division of Ser. No. 413,617, Nov. 7, 1973, Pat. No. 3,874,634.

[52] U.S. Cl. ..... 166/224 R

[51] Int. Cl.[2] ..... E21B 33/03; E21B 43/12

[58] Field of Search..... 166/72, 73, 224 R, 224 A; 251/319

[56] References Cited

UNITED STATES PATENTS

| | | | |
|---|---|---|---|
| 2,949,963 | 8/1960 | McGowen et al. | 166/224 |
| 3,073,392 | 1/1963 | Dinning et al. | 166/224 |
| 3,166,128 | 1/1965 | Myers | 166/224 X |
| 3,292,706 | 12/1966 | Grimmer et al. | 166/224 |
| 3,777,813 | 12/1973 | Dendy et al. | 166/72 |
| 3,786,863 | 1/1974 | Tausch | 166/72 |
| 3,860,066 | 1/1975 | Pearce | 166/72 |

*Primary Examiner*—James A. Leppink
*Attorney, Agent, or Firm*—H. Mathews Garland

[57] ABSTRACT

A safety valve system for use in a well having a tubing string for conducting well fluids to the surface, a landing nipple secured in the tubing string for the releasable engagement of a well tool locking mandrel, a sliding sleeve valve connected in the tubing string below the landing nipple and provided with a side port controlled by a sliding sleeve and communicating with a control fluid line extending to the surface, and a safety valve tool string including a locking mandrel releasably supported in the tubing string at the landing nipple, a sleeve shifting device connected with the locking mandrel for opening and closing the sliding sleeve valve when installing and removing the safety valve tool string, and a well safety valve supported from the sleeve shifting device and operable responsive to control fluid pressure introduced into the tubing string through the side port in the sleeve valve. Well safety valves of the ball type, poppet type, and flapper type are disclosed for use in the safety valve tool string. The sliding sleeve valve is opened when the safety valve tool string is introduced into operating position within the tubing string. The sleeve valve is closed when the tool string is removed from the tubing.

16 Claims, 10 Drawing Figures

WELL SAFETY VALVE SYSTEM

This is a divisional application of application Ser. No. 413,617 filed Nov. 7, 1973, now U.S. Pat. No. 3,874,634, issued Apr. 1, 1975.

This invention relates to well tools and more particularly relates to a well safety valves system.

Well safety valves and well systems of various types including safety valves are well known, particularly in the petroleum arts where oil and gas wells are drilled and produced for the purpose of recovering of valuable earth fluids. A variety of arrangements of well safety valve systems have been developed and used including some which employ a sliding sleeve valve. For example, in U.S. pat. No. 3,292,706 issued to G. G. Grimmer, et al Dec. 20, 1966, and assigned to Otis Engineering corporation shows a safety valve system in which an annulus pressure responsive valve is disposed in a sliding sleeve valve which when opened admits annulus pressure to the safety valve. When a predetermined annulus pressure is reached, the safety valve closes. A pressure differential across the safety valve forces into safety valve and the sliding sleeve valve upwardly closing the sleeve valve. To control line is used in this system. Various other arrangements of a movable well valve for controlling flow through a tubing string and sliding sleeve valves are shown in the prior art, though insofar as is presently known, there are no systems in which a surface controlled safety valve is installed in a well tubing string within a sliding sleeve valve which controls communication between the safety valve and a control pressure communicated from the surface in a control line.

In accordance with the invention there is provided a well safety system including a well tubing string having a locking mandrel and a side-ported sliding sleeve valve connected in tandem within the tubing string with a control fluid pressure line extending from the surface to the sleeve valve. A well safety valve tool string is provided including a locking mandrel for releasably locking the tool string in the tubing string at the landing nipple, a sleeve shifting device connected with the locking mandrel for opening and closing the sliding sleeve valve responsive to installation and removal of the tool string in the tubing string, and a well safety valve secured with the sleeve shifting unit and supported within the sliding sleeve valve controllable responsive to fluid pressure communicated to the sleeve valve through the control line from the surface. The sleeve valve is opened and closed by the sleeve shifter as the safety valve is installed in and removed from the sleeve valve. The safety valve is supported in the sleeve valve from the locking mandrel which is removably locked in the landing nipple.

It is a principal object of the invention to provide a new and improved safety valve system for a well.

It is another object of the invention to provide a well safety valve system wherein a surface controlled safety valve is installed through a sliding sleeve valve which controls control fluid pressure communication with the safety valve.

It is another object of the invention to provide a well safety valve system including a landing nipple and sleeve valve in the tubing string of a well and a safety valve tool string having a locking mandrel, a sleeve shifter, and a safety valve for installing, supporting and removing the safety valve in the tubing string at the sleeve valve and for manipulating the sleeve between open and closed positions during the installation and removal of the tool string.

It is another object of the invention to provide a new and improved sleeve shifter for operating a sliding sleeve valve in a well tubing string responsive to longitudinal movement of the sleeve shifter in the tubing string.

It is another object of the invention to provide a well safety valve system wherein the safety valve is responsive to control fluid pressure directed to the safety valve through a side port in a sliding sleeve valve communicated with the surface through a control fluid line.

The foregoing objects and advantages together with specific details of the invention will be better understood from the following detailed description taken in conjunction with the accompanying drawings wherein:

FIG. 1 is a fragmentary longitudinal view in section and in elevation showing a safety valve tool string supported in a well tubing string through a sliding sleeve in accordance with the invention;

FIGS. 2A, 2B, 2C, and 2D, taken together, constitute a longitudinal view in section and elevation of a safety valve tool string and well tubing structure as shown in FIG. 1 wherein the safety valve is of the ball type;

Figure 1:
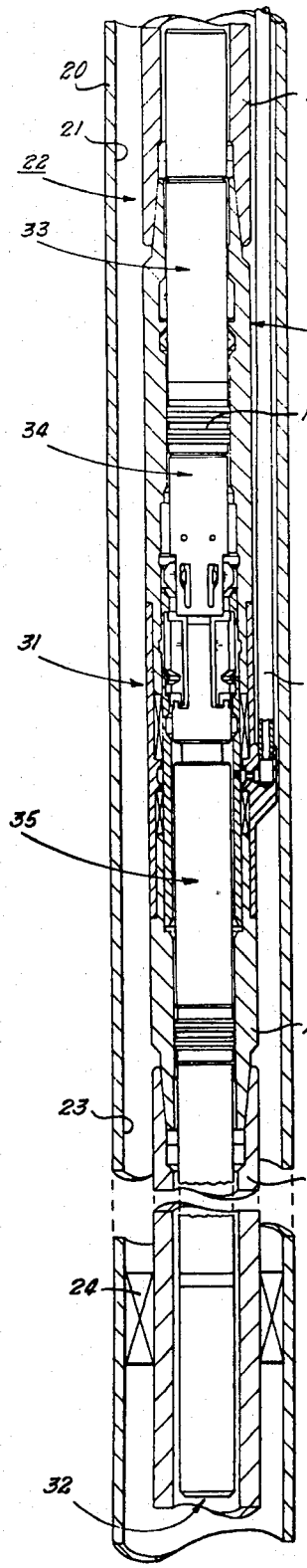

Referring to FIG. 1 a typical well installation including the safety valve system of the invention has a well casing 20 of conventional design for lining a well bore 21 and a tubing string 22 supported in the well bore from a wellhead at the surface, not shown. The annular space 23 around the tubing string within the well bore is typically sealed by a suitable packer engaged between the casing and the tubing string above the formation to be produced through the tubing string, not shown. The tubing string includes a plurality of conventional pipe sections 25 connected together to form a conduit from the wellhead to a desired depth below the packer. At the depth in the well at which a safety valve is to be installed a landing nipple 30 and a sliding sleeve valve 31 are connected together in the tubing string between adjacent ends of two pipe sections 25. The sleeve valve is connected to a control fluid line 26 leading to the surface.

In accordance with the invention a safety valve tool string 32 is releasably locked in the tubing string through the locking mandrel and sliding sleeve valve. The tool string includes a wireline controllable locking mandrel 33, a sleeve valve operating tool or shifter 34, and a remotely controllable safety valve 35. The locking mandrel 33 is a Type X Otis tool which is commercially available as illustrated and described at pages 3458 and 3459 of *The Composite Catalog of Oilfield Equipment and Services*, 1972–73 Edition, published by World Oil, Houston, Texas. The landing nipple 30, the sliding sleeve valve 31, the sleeve shifter 34, and the safety valve 35 are designed as illustrated and described herein. The sleeve valve is communicated with the surface by the control line 26 through which control fluid is directed to the safety valve for controlling the opening and closing of the valve. The sleeve shifter opens and closes the sleeve valve during installation and removal of the tool string. As the tool string is lowered in the tubing string to the proper depth, the sleeve valve is opened by the sleeve shifter so that when the safety valve is supported through the sleeve valve, control fluid may be directed to the safety valve to bias it open. When the tool string is retrieved from the tubing string, the sleeve shifter closes the sleeve valve. In the vent that the sleeve valve cannot be closed with the normal forces used for operating the sleeve shifter, the shifter shifts to an emergency release mode in which the tool string is removable from the landing nipple and sliding sleeve valve without damaging the sleeve shifter and the sleeve valve is then operated by tools especially designed for such emergency situations.

The landing nipple 30 has a reduced upper pin portion 41 threaded into the lower end of the pipe section 25 above the tubing nipple. The landing nipple is provided internally with a pair of spaced locking recesses 42 and 43 above and below a locking shoulder 44 which define a locking recess profile compatible with the locking keys on the mandrel 33 to permit the locking and release of the mandrel in the landing nipple. The landing nipple has a reduced lower end portion 45 threaded into a housing section of the sliding sleeve valve 31 forming the upper end of the sleeve valve housing, FIG. 2B. Below the landing nipple locking recesses 42 and 43 the nipple has a reduced bore portion 46 which serves as a seal surface for a seal assembly on the locking mandrel. Below the seal surface 46 the landing nipple has a downwardly diverging key operating cam surface 47 at the upper end of an annular recess 48. Below the recess 48 the landing nipple is further enlarged providing an elongated uniform bore portion 49 extending downwardly from a downwardly facing annular stop shoulder 50 through the lower end of the landing nipple housing providing a bore portion along which the valve member of the sliding sleeve operates. The bore portion 49 has longitudinally spaced upper and lower sleeve locking recesses 55 and 56, respectively, for locking the sleeve valve at an upper closed and a lower open position. The lower end portion 45 of the landing nipple is threaded into the upper end portion of a sleeve valve housing section 57. The lower end 45 of the landing nipple has an external annular recess fitted with a ring seal 58 which seals between the landing nipple and the sleeve valve housing section 57.

A longitudinally movable valve sleeve 59 is disposed in the connecting bores of the lower end portion of the landing nipple, the housing section 57 of the sleeve valve housing, and a section 60 of the sleeve valve housing. The sleeve valve 59 has a side port 61 which communicates with a side port 65 when the sleeve is at the lower open position shown in FIG. 2B. An annular seal assembly 66 is mounted around the sleeve 59 in the housing section 57 below the lower end edge 67 of the landing nipple portion 45. The seal assembly 66 is held against downward movement within the housing section 57 by an internal annular lock ring 68 engaged in an internal annular recess 69 of the housing section 57.

Another seal assembly 70 is positioned within the housing section 57 between the lock ring 68 and an upwardly facing stop shoulder 75 within the housing section above the side port 65. Below the housing section side port 65 another annular seal assembly 76 is mounted between a downwardly facing internal annular stop shoulder 77 within the housing section below the side port 65 and an upper end edge 78 on an upper reduced threaded section 79 of the lower sleeve valve housing section 60. A ring seal 80 in an external annular recess of the upper end portion 79 of the lower housing section 60 seals between the lower housing section and the housing section 57 below the seal assembly 76.

Figure 2A:
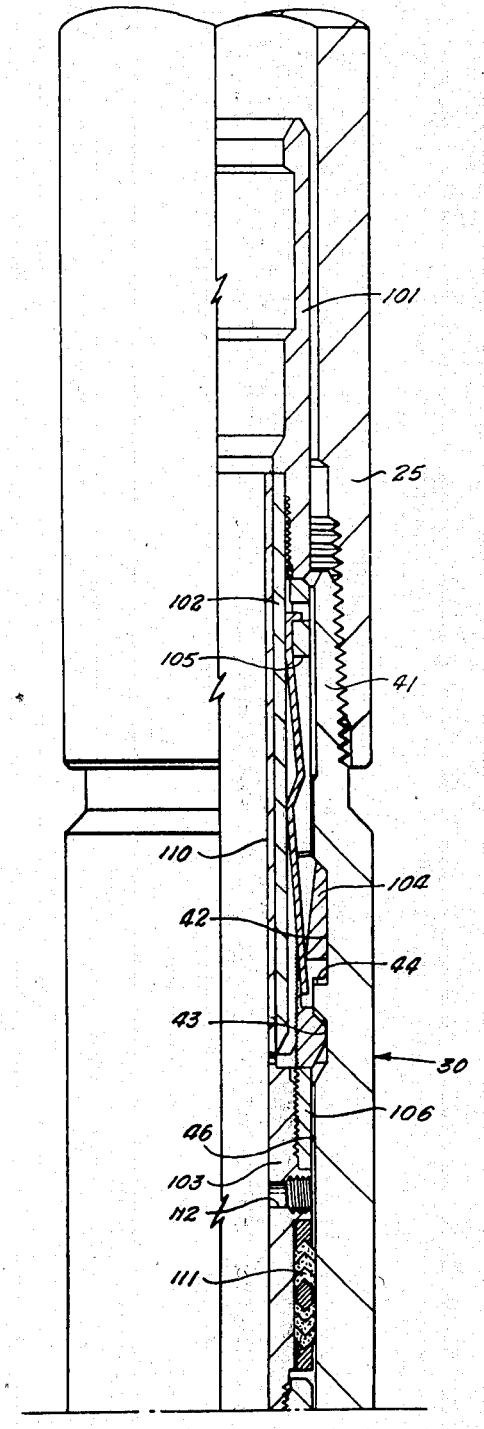
Figure 2B:
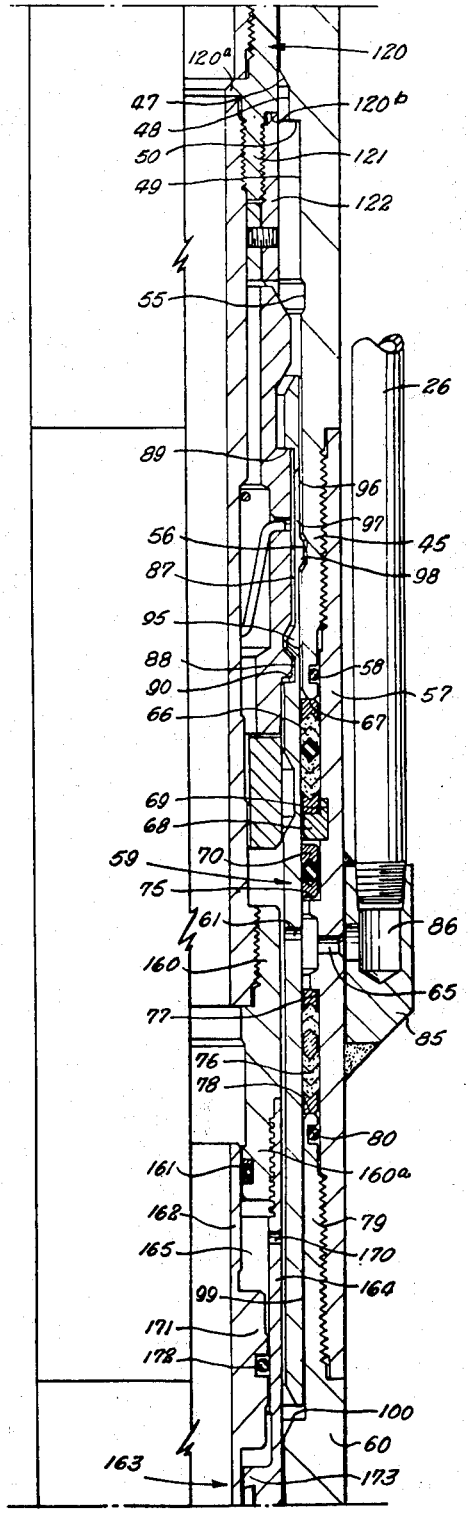

A side fitting 85 is connected along the side of the housing section 57 and provided with an L-shaped flow passage 86 to conduct control fluid into the side port 65 from the control line 26 which is connected into the fitting as seen in FIG. 2B. The control line communicates control fluid from the surface through the passage 86 and the side ports 61 and 65 into the safety valve 35 within the sliding sleeve valve for controlling the safety valve operation.

The sleeve valve 59 has upper internal recesses 87 and 88. The upper recess 87 is an elongated recess defined below a downwardly facing stop shoulder 89 within the sleeve valve. The lower end of the lower recess 88 is defined by an upwardly facing stop shoulder 90. Between the upper and lower recesses 87 and 88 an internal tapered flange 95 is provided. The upper end portion of the sleeve valve 59 is provided with longitudinal slots 96 which extend from just below the internal shoulder 89 to approximately the center of the internal shoulder 95. The slots 96 are circumferentially spaced so that a plurality of circumferentially spaced collet fingers 97 are defined along the sleeve valve. Each of the collet fingers has an external locking boss 98. The bosses 98 on the collet fingers are engageable in either of the upper and lower locking recesses 55 and 56 along the lower end portion 45 of the landing nipple, as seen in FIG. 2B, to releasably lock the sleeve valve at an upper closed position and at a lower open position, as shown in FIG. 2B.

The upper end portion 79 of the lower sleeve valve housing section 60 has a bore portion 99 in which the lower end portion of the sleeve valve 59 slides. An internal annular upwardly facing stop shoulder 100 within the housing section 60 at the lower end of the bore portion 99 limits the downward movement of the sleeve valve 59 to the open position shown in FIG. 2B. Thus, the sleeve valve is movable between the shoulder 50 within the lower end portion 45 of the landing nipple and the shoulder 100 within the upper end portion 79 of the lower housing section 60. When the upper end edge of the sleeve valve is engaged with the shoulder 50, the valve is closed; when the lower end edge of the sleeve valve engages the shoulder 100, the valve is open. The sleeve valve housing section 60 has a reduced lower end pin portion 101 threaded into the upper end of the tubing section 25 which extends downwardly through the packer 24. Since the landing nipple 30 and the sliding sleeve valve 31 are an integral part of the tubing string 22, they are made up in the string as the string is run into the well bore.

The type X Otis locking mandrel 33 has a fishing neck 101 connected with an expander mandrel 102 supported on a body or packer mandrel 103. A plurality of circumferentially spaced radially movable locking dogs 104 are disposed in circumferentially spaced windows 105 in a sleeve 106 secured on the mandrel 103. The dogs are coupled with double acting springs 110 which bias the dogs outwardly to locating positions for properly seeking and stopping the locking mandrel at locking recesses within a locking nipple, such as the nipple 30 in a tubing string. An external seal assembly 111 is supported along the lower end portion of the mandrel 103 for sealing with the seal surface 46 in the landing nipple. The mandrel 103 has a shear screw hole 112 for connecting the mandrel with a suitable running tool, not shown, such as the Otis Type X running tool shown at page 3459 of *The Composite Catalog of Oilfield Equipment and Services*, supra. Further details on the structure and operation of the locking mandrel and running tools are found in the reference catalog.

The lower end portion of the locking mandrel body 103 is connected into the sleeve shifter 34 which operates the sliding sleeve valve 31 and supports the safety valve 35 within the sleeve valve. The details of the sleeve shifter are principally shown in FIGS. 2B, 5, 6, and 7. The sleeve shifter has a top sub 120 which threads on the bottom end of the locking mandrel 33 as illustrated in FIGS. 2A and 2B. The top sub 120 has a reduced lower end portion 121 which is internally and externally threaded for connection with an outer sleeve 122 and an inner elongated body mandrel 123. The sleeve 122 threads onto the top sub 121 while the mandrel 123 threads into the sub so that the sleeve and mandrel are in concentric spaced relationship as seen at the upper portion of FIG. 2B. Fitted around the inner mandrel 123 and extending upwardly into the sleeve 122 is an inner sleeve 124 which is substantially longer than the sleeve 122 and telescopes into the sleeve 122 along an upper end portion. A pair of sleeve-shifting keys 125 are supported in operative relationship with the sleeves 122 and 124 around the mandrel for radial expansion and contraction to engage with and disengage from the sleeve valve 59 of the sliding sleeve valve 31. The outer sleeve 122 has a pair of slots 130 along opposite sides of the sleeve opening through an end of the sleeve and defining a pair of identical oppositely disposed leg portions 131. Each of the leg portions has two guide windows 132 which include a wide key expansion portion 133 and a narrow key contracting or release portion 134. The pair of guide windows adjacent to and on opposite sides of each of the sleeve slots 131 guide the end of the key 125 in that slot between expanded and contracted positions as the key is moved longitudinally. The sleeve 122 has four circumferentially spaced holes 135, each of which receives a threaded shear screw 140 for releasably securing the inner sleeve 124 with the outer sleeve 122 in the normal running relationship shown in FIG. 2B.

Figure 5:
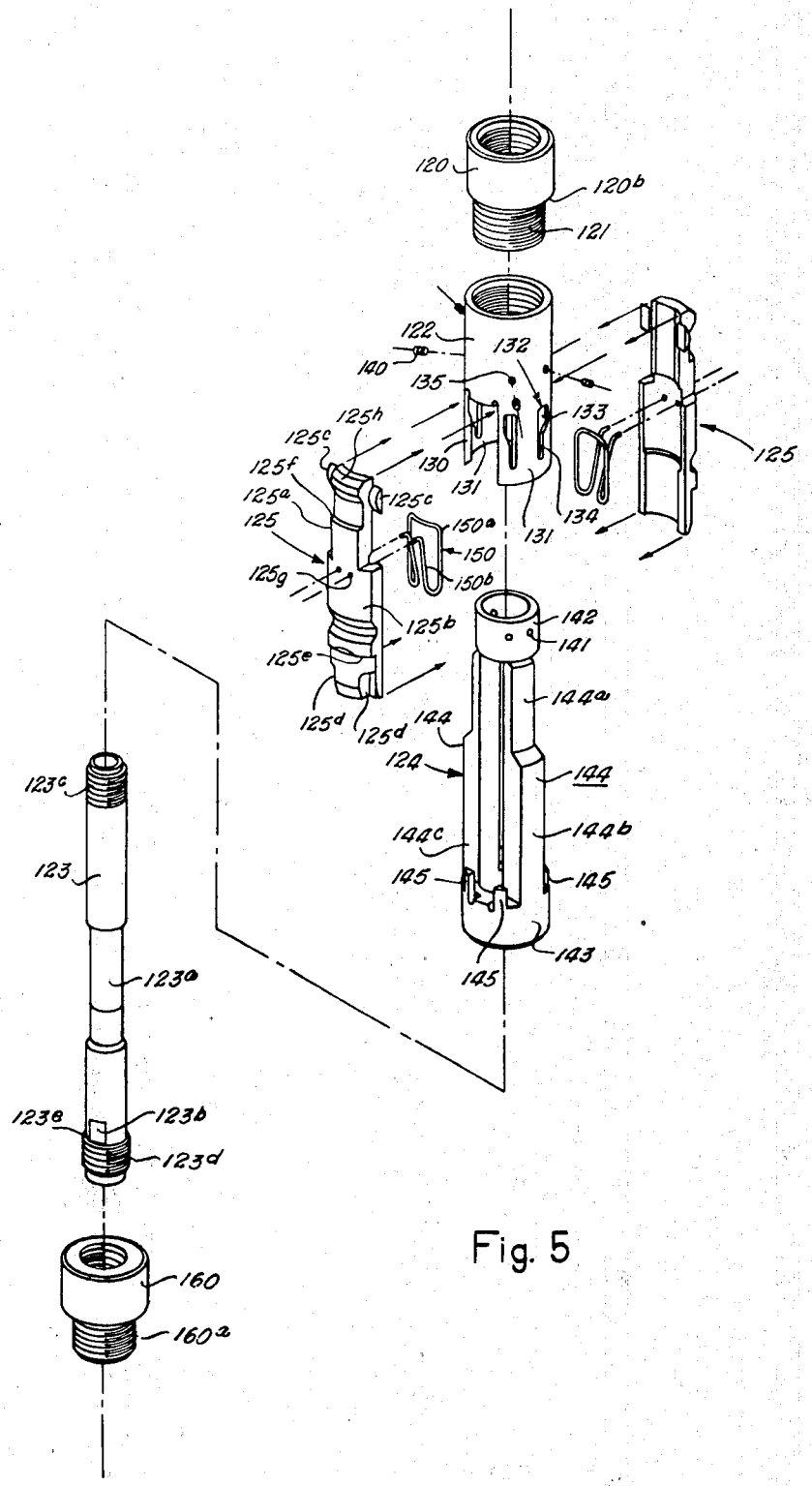
FIG. 5 is an exploded view in perspective of the sleeve shifter of the safety valve tool string of the invention.

The shear screws 140 extend through the holes 135 into corresponding holes 141 in a head ring 142 of the inner sleeve 124 supporting the inner sleeve within the outer sleeve 122 in the concentric relationship seen in FIG. 2B. The inner sleeve 124 has a base ring 143 connected with the head ring 142 by a pair of parallel longitudinal body members 144, each of which has cylindrical inner and outer surface portions to conform the member surfaces to the body mandrel 123 and the inner wall surfaces of tubing string, landing nipples, and the like. The longitudinal body members 144 have upper thin-wall portions **144*a* and lower thick-wall portions 144*b*. The effective outside diameter of the thin-wall portions 144*a* is scaled to permit the inner sleeve to telescope into the outer sleeve, as shown in FIGS. 2B and 5, with the longitudinal center lines of the side members 144 aligned with the center lines of the outer sleeve legs 131 so that the key windows 132 in each leg 131 are on opposite sides of the inner sleeve side member 144 which is aligned with and adjacent to the leg 131. The effective outside diameter of the outer sleeve side portions 144*b* is substantially equal to the outside diameter of the outer sleeve 122. The flat side surfaces 144*c* of the inner sleeve side members 144 between the rings 142 and 143 and the downwardly opening key slots 130 of the outer sleeve 122 define an inverted T-shaped side pocket down each side of the assembled inner and outer sleeves for the keys 125. The base ring 143 of the inner sleeve has a pair of upwardly extending key retainer fingers 145 circumferentially spaced and symmetrically formed on each side of the inner sleeve extending upwardly from the base ring spaced from and parallel to the flat side surfaces 144*c* of the side members of the inner sleeve. The fingers 145 serve to retain the foot or lower ends of the keys 125** in proper positions along each side of the inner sleeve permitting radial contraction and expansion of the keys while limiting the maximum expansion of the keys.

The pair of keys 125 of the sleeve shifter are adapted to engage with and release from the sleeve valve 59 of the sliding sleeve valve 31. The keys each have a narrow head portion **125*a* and a wider body portion 125*b* providing an inverted T-shaped which loosely fits within each pocket defined along the opposite vertical sides of the assembled inner and outer sleeves. The key head portion 125*a* is of a width which loosely fits within the downwardly opening slot 130 on each side of the outer sleeve 122. A pair of sidewardly extending retainer and guide ears 125*c* are formed on each of the head ends of the keys for engagement with the retainer and guide windows 132 on each side of the sleeve 122. As best understood from FIG. 5, the ears 125*c* fit into a guide window in one of the legs 131 and a corresponding guide window in the other opposite leg 131 to maintain a coupled relationship between the head ends of the keys and the outer sleeve while permitting the keys to move longitudinally and to expand and contract radially between locking and release positions. Each of the keys has a pair of vertical, downwardly opening retainer slots 125*d* formed along each side of the lower end portion of the body section 125*b* of each key, sized and spaced to receive the pair of upwardly extending retainer fingers 145 on the side of the sleeve 124 holding the lower ends of the keys in operative relationship with the inner sleeve while permitting the necessary contraction and expansion of the keys. Each of the keys has an outer surface profile matching the operating recess profile within the sliding sleeve valve and landing nipple so that the keys readily engage with and disengage from the sleeve valve 59 in opening and closing the sliding sleeve valve. Each key has a downwardly facing abrupt operating shoulder 125*e* for engaging and opening the sleeve valve and an abrupt upwardly facing shoulder 125*f* used to engage and close the sleeve valve. The keys are biased outwardly by springs 150 positioned within the keys around the inner body mandrel 123. Each spring has a 3-sided rectangular body portion 150*a* which rests on the cylindrical outer surface of the portion of the body mandrel within the key. Each key also has outer arms 150*b* with hookshaped ends engageable in two holes 125*g*** through the central portion of each of the keys to keep the springs aligned within the keys along the body mandrel. The body mandrel 123 is reduced in diameter or undercut along a central portion 123*a* which lies behind substantially the full length of the keys 125 when the shifter is assembled and provides the necessary space for the springs 150 and to allow the keys to move inwardly or contract fully for release of the shifter from the sleeve valve and when the shifter is moving through the tubing string. A pair of flat surfaces 123*b* are provided for engagement of a holding tool during assembly of the shifter. The threaded upper end portion 123*c* of the body mandrel engages in the internal threaded lower end portion of the top sub 120. As shown in FIG. 2B, the top sub has an internal annular flange 120*a* to position the upper end of the body mandrel 123 in the top sub. As also evident in FIG. 2B, the top sub 120 threads into the outer sleeve 122 to the external annular stop flange 120*b* on the top sub while the upper end of the mandrel 123 threads into the top sub to the internal flange 120*a*. The mandrel 123 extends the entire length of the inner sleeve 124 and through the outer sleeve 122 into the top sub. The lower end portion 123*d* of the mandrel 123 is externally threaded for connection into a bottom sub 160 provided with a reduced threaded lower end portion 160*a* which, as shown in FIG. 2B, forms the head end of the safety valve 35. The mandrel 123 has an upwardly facing stop shoulder 123*e* at the upper end of the threaded section 123*b* which limits downward movement of the inner sleeve 124 during release of the shifter from a stuck sleeve valve.

When the sleeve shifter is fully assembled as in FIG. 2B with the inner and outer sleeves connected together by the shear screws 140, the operating keys 125 float within the side pockets defined, as previously discussed, along the opposite sides of the sleeves 122 and 124 and including the two slots 130 in the sleeve 122 with the springs 150 biasing the keys outwardly to sleeve valve engaging positions. So long as the sleeves 122 and 124 are interconnected by the shear screws, the keys may not move longitudinally though they are free for the expansion and contraction between sleeve engaging and release positions. Longitudinal movement of the keys is possible only when the screws 140 are sheared releasing the inner sleeve 124 for downward movement with the keys to lower longitudinal positions at which the head ends of the keys are cammed inwardly by the narrow lower window ends 134 in which the key ears 125*c* ride. Further discussion of the sleeve shifter operation will be found in connection with the procedure of installing and removing the safety valve tool train.

Figure 2C:
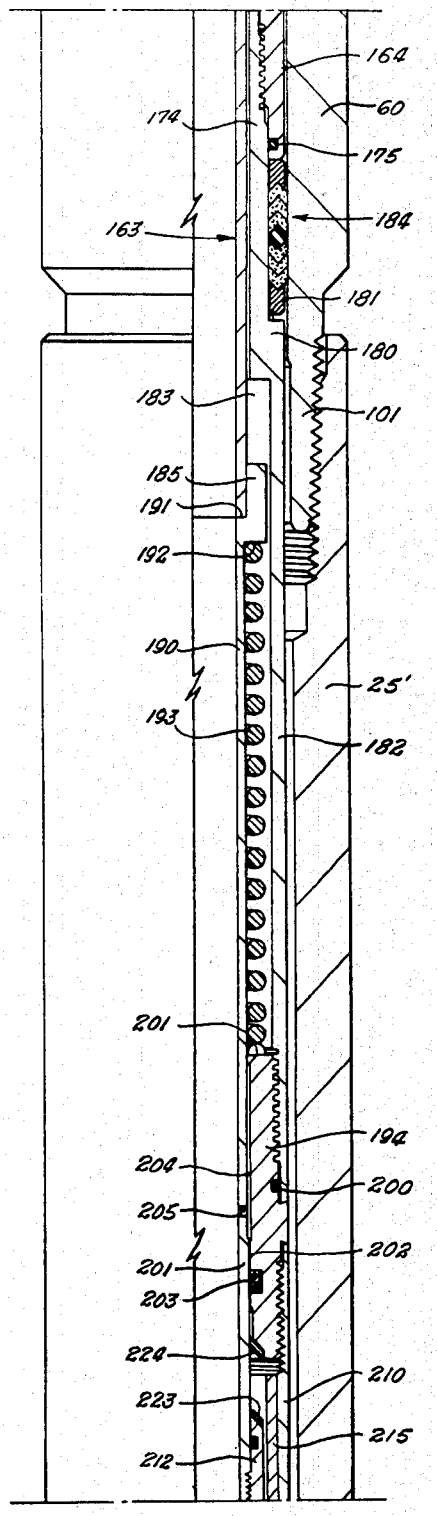
Figure 2D:
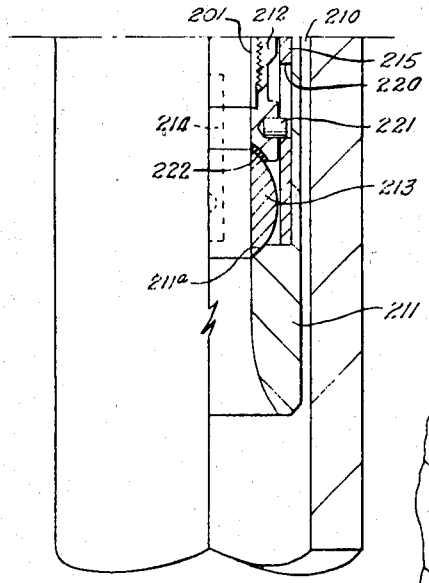
Figure 6:
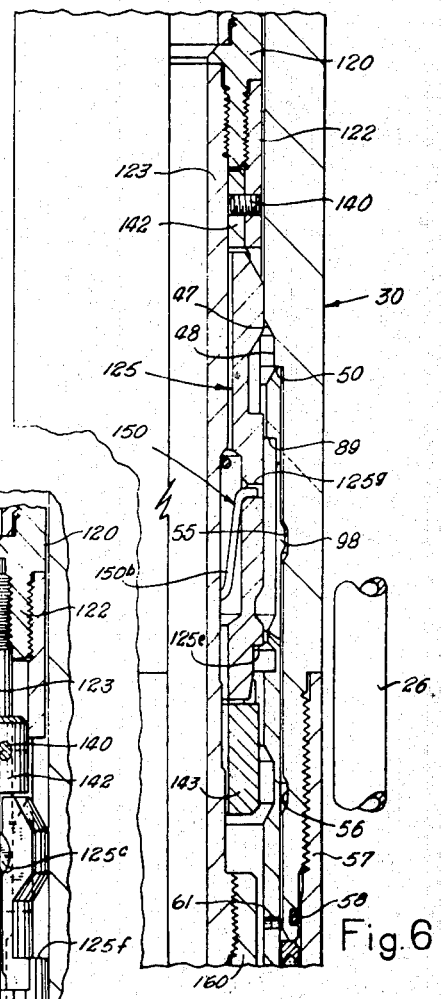
FIG. 6 is a fragmentary view in section and elevation showing principally the sleeve shifter with the sleeve operating keys in the normal running mode during installation and removal.

The safety valve 35 is shown in detail in the lower portion of FIG. 2B and FIGS. 2C and 2D. Referring to FIG. 2B, the bottom sub 160 of the sleeve shifter 34 forms the head end of the safety valve securing the safety valve to the sleeve shifter. The bottom sub has an internal seal assembly 160 in an internal annular recess formed within the lower end portion of the sub for sealing with a reduced upper end portion 162 of a valve operator tube section 163 of the safety valve 35. The bottom sub is threaded into the upper end of a housing head end 164 disposed in concentric spaced relation around the valve operator tube defining an annular control fluid chamber 165 between the operator tube and the housing head at the upper end of the safety valve. A side port 170 in the housing head end communicates control fluid to the annular chamber 165 for applying a fluid pressure to an annular piston 171 formed around the operator tube 163 for moving the valve operator tube downwardly to open the sliding sleeve valve responsive to control fluid pressure. The valve housing head end 164 has an internal flange 173 defining a bottom stop at the lower end of the control fluid chamber 165 below the piston 171. An external annular seal 172 in an external annular recess of the piston 171 seals around the piston with the inner wall surface of the valve housing head 164. The valve head housing 164 threads onto a housing section 174 which is enlarged at 180 providing an upwardly facing external annular stop shoulder 181 which serves a seal support function. An enlarged housing section 182 extends downwardly from the portion 180 in concentric spaced relation from the valve operator tube 163 defining a spring and fluid chamber 183 between the operator tube and the housing section. An external annular seal 184 is supported on the housing section above the shoulder 181 below the lower end edge of the valve head section 164 to seal around the valve housing section with the inner wall surface of the sleeve valve connector portion 60. The lower end of the valve control tube section 163 fits into a valve control tube head 185 on a lower valve operator tube section 190. An internal stop shoulder 191 within the head 185 provides a seat for the lower end edge of the operator tube section 163. A downwardly facing external annular stop shoulder 192 is provided on the head 185 for the upper end of a spring 193 within the chamber 183 for biasing the safety valve closed. The valve operator tube section 190 is slidable through a housing connector 194 which threads into the lower end of the housing section 182. The upper end edge of the connector section 194 provides an upwardly facing stop shoulder 201 which supports the lower end of the spring 193. A ring seal 200 in an external annular recess of the connector 194 seals between the connector and the lower end of the outer housing section 182.

The upper end edge 201 of the connector section 194 provides a stop shoulder for the lower end of the spring 193. The operator tube section 190 is slightly enlarged at 201 while the bore through the housing connector 194 is slightly reduced at 202 providing a close sliding fit between the operator tube section and the housing section. An internal ring seal assembly 203 within the housing connector section seals between the housing section and the operator tube section. Above the portion 201 of the operator tube section 190 and the portion 202 of the housing connector 194, the operator tube and housing connector are spaced slightly apart defining a small annular space 204 which communicates at an upper end with the spring chamber 183. A side portion 205 is provided in the operator tube section 190 above the enlarged portion 201 to communicate the bore through the safety valve with the space between the operator tube section and the safety valve housing section 182 along the spring 193 and extending upwardly between the operator tube sections and the housing sections to the piston 171 on the head end of the operator tube section 163 below the seal 172, thereby applying well pressure to the piston which cooperates with the force of the spring 193 to close the safety valve.

The housing connector section 194 is threaded into a lower housing section 210 which supports and is formed integral with a bottom ball valve housing section 211 having an upwardly and inwardly facing ball valve seat 211*a*. The operator tube portion 201 is threaded into a valve member 212 which supports a ball valve 213. The ball valve hangs from the valve member 212 on a pair of oppositely disposed hanger members 214. A guide sleeve 215 is disposed within the housing portion 210 and provided with a pair of longitudinal slots 220. A pair of guide pins 221 are engaged in opposite sides of the seat member 212 and extend radially outwardly into the guide slots 220 to hold the ball valve assembly against rotation in the housing as it is moved longitudinally for opening and closing the ball 213. A downwardly and inwardly facing arcuate seat 222 is formed in the lower end of the valve member 212 to seal with the ball valve 213. At the upper end of the valve member 212, FIG. 2C, another valve seat 223 is formed for engagement with a valve seat 224 within the lower end of the housing connector 194 so that when the ball valve 213 is lifted and rotated to the closed position, not shown, the valve member 212 which supports the ball valve seals off with the connector section 194 to prevent fluid flow upwardly around the ball valve assembly into the valve housing. The ball valve structure shown at the lower end of FIG. 2D and in FIG. 2D is standard shown at the lower end of FIG. 2D and in FIG. 2D is standard commerically available apparatus of the type shown as an Otis Remote-Controlled Ball-Type Subsurface Safety Valve shown at page 3501 of *The Composite Catalog of Oilfield Equipment and Services*, supra. Similar types of ball valve structures which may also be used are shown in a patent to G. C. Grimmer, et al, U.S. Pat. No. 3,292,706 issued Dec. 20, 1966, and assigned to Otis Engineering Corporation.

Figure 3:
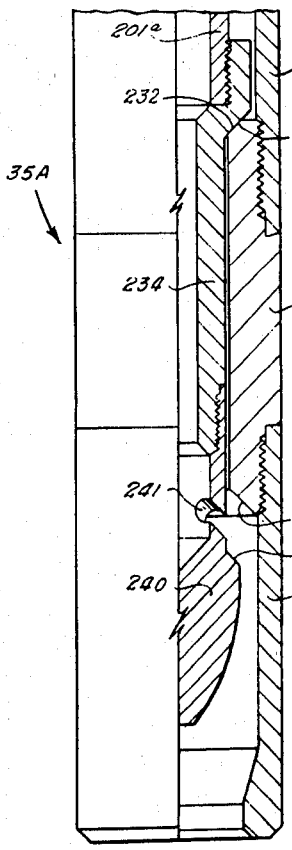
FIG. 3 is a fragmentary view in section and elevation of a poppet type safety valve usable in the tool string.
Figure 4:
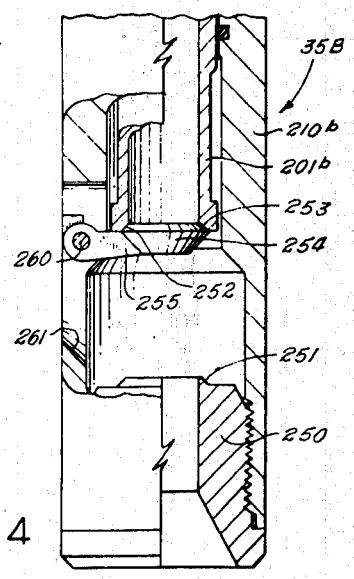
FIG. 4 is a fragmentary view in section and elevation of a flapper type safety valve usable in the tool string of the invention.

Alternate forms of valve types which may be used in lieu of the ball valve of FIG. 2D are shown in FIGS. 3 and 4 which illustrate poppet and flapper type valves, respectively. Referring to FIG. 3, a poppet type safety valve 35A is illustrated for use in the safety valve tool string. The actuating apparatus of the poppet valve is identical to that shown in FIGS. 2B and 2C so that the valve is held open by control fluid pressure from the surface and is closable when that control fluid pressure is reduced in response to the force of the spring 193 and tubing pressure applied to the piston 171. The poppet type safety valve 35A includes a lower housing section 210*a* threaded onto a valve seat member 230 which is connected to a lower end member 231. The valve seat member 230 has an upwardly and inwardly facing stop shoulder 232 and a downwardly and inwardly facing valve seat 233. A lower operator tube section 201*a* is threaded into a coupling 234 which has a downwardly and inwardly sloping stop shoulder 235 to limit the downward movement of the poppet valve when the valve is open as shown in FIG. 3. The coupling 234 is threaded into a poppet valve 240 having ports 241 and an external, upwardly and inwardly sloping seat 242. In the open position shown in FIG. 3, well fluids flow upwardly through the ports 241 in the poppet valve 240. The valve operator tube section 201*a* lifts the coupling 234 and the poppet valve 240 until the seat 242 engages the housing seat 233 at which position well fluids may not flow upwardly through the safety valve.

In the flapper type valve 35B shown in FIG. 4, a lower valve housing portion 210*b* is secured with a bottom nose portion 250 which has an upwardly extending top seat surface 251. The lower end of the valve operator tube 201*b* is provided with an internal downwardly facing annular valve seat surface 252 which is engageable with a seat surface 253 on a flapper valve 254. The flapper valve has an arm 255 hinged on a pin 260 within the upper end of a side pocket 261 formed along the side of the lower end portion of the bottom housing section 210*b*. When the valve 35B is closed as shown in FIG. 4, the flapper valve 254 engages the lower seat surface 252 on the lower end of the valve operator tube 201*b*. The valve 35B is opened by moving the operator tube 201*b* downwardly pivoting the flapper valve 254 clockwise on the pin 260 into the side pocket 261. The downward movement of the operator tube 201*b* is stopped by engagement of the tube seat 252 on the seat 251 of the bottom nose member 250 of the valve housing. The operating structure of the safety valve 35B which functions to open and close the valve is identical to that illustrated in FIG. 2C.

The safety valve tool train 32, as shown assembled in FIG. 1, may include a safety valve of the ball, poppet, or flapper type, as desired. A well is completed for the use of the tool drain by fitting the well with a tubing string including the landing nipple 30, the sliding sleeve valve 31, a packer 24 sealing around the tubing string within the casing of a production formation, and a control fluid line 26 extending from a suitable control system at the surface through the well annulus to the sliding sleeve valve.

The safety valve tool string is run into the well tubing on a flexible wireline supported from a suitable string of wireline tools, including jars and a running tool which is releasably engageable with the locking mandrel 33. Such wireline equipment is illustrated and described at pages 3478–3484 of *The Composite Catalog of Oilfield Equipment and Services*, supra, showing an Otis wireline tool string together with running and pulling tools useful in installing and retrieving the safety valve tool string of the invention. Prior to the running of the safety valve tool string, the sliding sleeve valve 35 is closed with the valve member 59 of the sleeve valve being at an upper end position within the sleeve valve housing. When closed, the boss 98 of the sleeve valve 59 is engaged in the upper locking recess 55 in the nipple 30, FIG. 6, and the upper end of the sleeve valve engages the shoulder 50. At this position of the valve member, the side port 61 in the sleeve valve is above the packing 66 and thereby isolated from the housing side port 65 so that control fluid cannot be communicated from the line 26 into the bore of the sleeve valve. The sleeve shifter 31 is in normal running condition, as shown in FIGS. 1 and 2B, at which the sleeve 124 is shear pinned with the sleeve 122 holding the keys 125 at the upper operating position at which the keys freely expand and contract as they drag along and pass various recesses, shoulders, and the like in the tubing string. In this mode, the keys are not free to move longitudinally and are used for opening and closing the sliding sleeve valve.

The safety valve tube string 32 is lowered by means of the wireline until the safety valve 35 and the sleeve shifter 31 have passed through the landing nipple 30. As the sleeve shifter passes downwardly into the sliding sleeve valve, the keys 125 expand upon reaching the operating recesses within the upper end portion of the sleeve valve 59. The lower end portions of the keys expand sufficiently as they enter and move along the operating recesses of the valve member that the downwardly facing operating shoulder 125*e* on each of the keys enters the recess 88 of the valve member engaging the upwardly facing operating shoulder 90 of the sleeve valve. Since the shoulders 125*e* and 90 of the keys and valve member, respectively, are 90-degree shoulders, the keys are not cammed back inwardly but rather lodge against the sleeve valve so that a downward force is transmitted by the sleeve shifter keys to the sleeve valve. When the downward force is sufficient to overcome friction and the holding force of the collect finger bosses 98 in the locking recess 55 of the sleeve valve, the bosses are cammed inwardly from the locking recess releasing the sleeve valve for downward movement. The safety valve tool string continues moving downwardly with the sleeve shifter keys fully engaging the sleeve valve and forcing the sleeve valve downwardly to the lower open position shown in FIG. 2B. The relationship of the profiles of the recesses within the sleeve valve and on the keys of the sleeve shifter prevent the keys of the shifter from being cammed inwardly so that the keys remain coupled with the sleeve valve member preventing the shifter moving upwardly or downwardly relative to the sleeve valve. Also, the locking bosses 98 on the collet fingers of the sleeve valve expand into the lower locking recess 56 of the sleeve valve housing releasably locking the sleeve valve open. When the sleeve valve reaches the lower open position of FIG. 2B with the sleeve shifter coupled with the valve member as described, the locking keys 104 of the locking mandrel 33 are aligned with and expand into the locking recesses 42 and 43 of the landing nipple 30. The expander mandrel 102 of the locking mandrel is activated to wedge the keys outwardly to lock the locking mandrel with the landing nipple. Generally, the running tool used will include a prong, not shown, extending downwardly from the tool to hold the safety valve open so that well fluids may flow through the valve as it is lowered in the well bore to the landing nipple. The prong is retrieved with the running tool releasing the safety valve for remote control operation.

With the safety tool train locked with and supported from the landing nipple through sliding sleeve valve, the safety valve is opened for well flow by applying control fluid pressure from a suitable controllable source at the surface through the line 26 leading to the sleeve valve. The control fluid flows into the sleeve valve housing through the side port 65, around the sleeve valve 59 between the upper seal 70 and the lower seal 76 which span the side port. The control fluid flows through the side port 61 in the sleeve valve into the annulus space within the sleeve valve member around the safety valve tool train. The control fluid fills the annular space around the train within the landing nipple 30 and sleeve valve housing extending from the seal 111 at the upper end, FIG. 2A, downwardly to the seal 184 at the lower end. The control fluid flows laterally inwardly through the side port 170 at the head end of the safety valve into the annular chamber 165 above the operator piston 171 of the safety valve. The pressure of the control fluid acts downwardly on the piston against the upward force of the spring 193 and the well pressure within the tubing string as applied through the side port 205 upwardly on the piston. When the control fluid pressure applies sufficient downward force to the piston to overcome the spring and well pressure forces, the safety valve is opened, as shown in FIG. 2D, by the downward movement of the safety valve operator tube on which the piston 171 is formed. So long as the control fluid pressure is maintained sufficiently high, the safety valve remains open. When closure of the safety valve is desired, the control fluid pressure is reduced so that the force of well pressure through the side port 205 and the spring 193 lift the operator tube of the safety valve closing the valve.

The safety valve tool string 32 is removed from the tubing string by a wireline tool string and an appropriate pulling tool which engages the locking mandrel 33. Application of an upward force to the fishing neck of the locking mandrel releases the locking keys on the mandrel so that the tool string may be pulled upwardly from the landing nipple 30. The upward force is applied to the sleeve shifter 34 which transmits the upward force through the keys 125 to the shoulder 89 of the sleeve valve. The inner sleeve 122 and outer sleeve 124 of the sleeve shifter are secured together by the shear pins 140 so that the upward force applied to the sleeve shifter is transmitted from the inner and outer sleeves to the keys 125 through the lower ends of the keys which rest on the ring 143 of the sleeve 124 at the upwardly extending fingers 145. The resistance of the sleeve valve 59 applies an opposing downward reaction force to the sleeve shifter keys through the downwardly facing internal shoulder 89 of the sleeve valve which engages the upward facing shoulders 125*f* on the keys 125. Thus, the upward force applied to the sleeve shifter is actually transmitted through the shoulder 125*f* on the keys to the sleeve valve. This upward force cams the locking bosses 98 on the collet fingers of the sleeve valve inwardly releasing the sleeve valve from the lower locking recess 56 within the sliding sleeve valve housing, FIG. 2B. The sleeve valve is then lifted by the sleeve shifter keys. When the release shoulder surface 125*h* on each of the keys reaches the inwardly sloping internal cam surface 47 within the sleeve valve housing, the sleeve shifter keys are cammed inwardly at the upper ends of the keys disengaging the key shoulders 125*f* from the internal operating shoulder 89 at the upper end of the sleeve valve 59. The sleeve valve and sleeve shifter key surfaces are dimensioned and proportioned such that by the time the keys 125 are cammed inwardly sufficiently along the upper end portions of the keys to release the keys from the sleeve valve, the sleeve valve is moved to the upper closed position at which the side port 61 of the valve member is above the seal assembly 66. With the safety valve tool string fully released from the landing nipple and sliding sleeve valve, the tool string is pulled back to the surface with the wireline, leaving the sliding sleeve valve closed.

Figure 7:
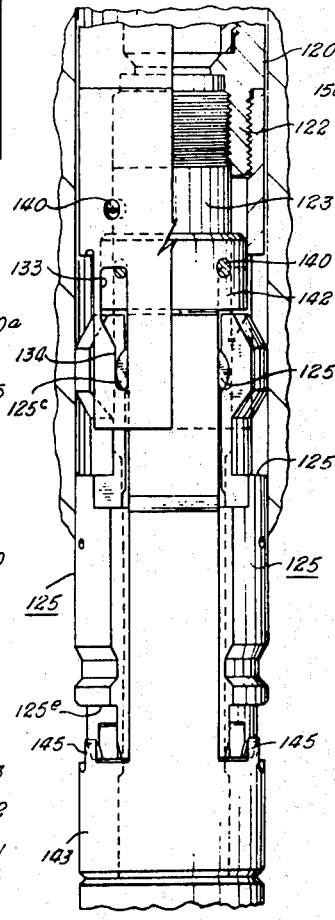
FIG. 7 is a fragmentary view in section and elevation of the sleeve shifter showing the keys in this emergency release mode for freeing the shifter from a jammed or stuck sleeve valve.

In the event, in removing the safety valve tool string from the landing nipple and sliding sleeve valve, it is found that the sleeve valve 59 is jammed open and cannot be released and closed with normal force without damaging the sleeve shifter, the sleeve shifter has means for an emergency release from the sleeve valve. The upward force which can be safely applied to the sleeve shifter without damaging it is a force which is below the shear strength of the screws 140 which couple the outer sleeve 122 with the inner sleeve 124. It will be recalled that when an upward force is applied to the sleeve shifter which is transmitted to the sliding sleeve valve through the keys 125, the keys may be said to be carried upwardly by the lower ring portion 143 of the sleeve 124 as the upward force is applied from the head 120 of the sleeve shifter to the outer sleeve 122, and through the shear screws 140 to the inner sleeve head 142, with the inner sleeve supporting the keys insofar as upward force is concerned. Thus, with the keys and the inner sleeve being urged downwardly by the reaction of a stuck sleeve valve, the resistance of the sleeve valve applies a higher shear force to the screws 140. When this force exceeds the capability of the screws to hold, they are sheared, as represented in FIG. 7. The downward resistance of the sliding sleeve valve on the keys 125 holds the keys and thus the sleeve 124 against upward movement. With the keys and the sleeve 124 being held and the shear screws severed, the sleeve shifter head 120, the sleeve 122, and the mandrel 123 are lifted relative to the keys and the sleeve 124. As the sleeve 122 moves upwardly, the ears 125*c* on the upper ends of each of the keys 125 are guided into the narrow lower guide window portions 134 of the sleeve 122 camming the upper ends of the keys inwardly so that the shoulder 125*f* on each of the keys is disengaged from the shoulder 89 within the upper end portion of the sleeve valve 59. The other upwardly facing surfaces on the sleeve shifter keys slope upwardly and inwardly and the lower end portions of the keys are held out only by the outward force of the springs 150 so that with the keys released from the abrupt shoulder contact, the upward force on the sleeve shifter cams the keys fully inwardly to the positions shown in FIG. 7 so that the sleeve shifter is released from the sleeve valve member allowing the safety valve tool train to be pulled by the wireline to the surface leaving the sleeve valve, however, open. The sleeve valve then must be closed in a separate operation by use of special conventional wireline tools designed to perform the emergency procedure of closing the sleeve valve.

The sleeve shifter 31 may be returned to normal operating condition at the surface by removal of the shear pin fragments, returning the keys and inner sleeve back upwardly to the positions of FIGS. 1 and 2B, and reinsertion of new shear pins 140 to reconnect the inner and outer sleeves 122 and 124 together.

The well safety valve system of the invention thus includes a safety valve which is supported from a landing nipple above a sleeve valve and extends downwardly through the sleeve valve with control fluid pressure being supplied through the sleeve valve to the safety valve from a control line extending to the surface. The tool train includes a sleeve shifter which opens and closes the sleeve valve as a continuous integral operation of the installation and retrieval procedure of the safety valve tool string. An emergency safety feature of the sleeve shifter permits the release of the sleeve shifter from the sliding sleeve valve without damaging the shifter in the event that the valve of the sliding sleeve valve becomes jammed such that it cannot be moved by normal forces which can be applied to the sleeve shifter without damage to the shifter parts.

What is claimed is:

1. A well safety valve system comprising: a tubular housing connectible in a well tubing string to form a continuous part of said tubing string in a well bore, said housing having a side port for communication into the bore through said housing from exterior of said housing, a tubular sleeve valve having a side port therein slidably positioned within said housing and movable between an open position at which said sleeve valve port communicates with said housing port and a closed position at which said ports are isolated from each other for controlling flow into said housing through said side port in said housing; a well safety valve adapted to be supported in said tubing string of a well in communication with said side port in said tubular housing for controlling fluid flow through said tubing string responsive to a control fluid pressure communicated to safety valve through said side port in said housing; means connected with said safety valve for selectively engaging said sleeve valve including a single element operating key having a shoulder for opening said tubular sleeve valve and spaced therefrom a shoulder for closing said tubular sleeve valve; and means for releasably locking said safety valve in said tubing string only when said sleeve valve is at an open position.

2. A well safety valve system in accordance with claim 1 wherein said means for locking said safety valve in said tubing string includes means defining a locking recess within said tubular housing and a locking mandrel connected with said safety valve and having expandable and contractible locking dogs engageable with said locking recess of said housing when said sleeve valve is at said open position.

3. A well safety valve system in accordance with claim 1 wherein said operating key for engaging and opening said sleeve valve is positioned to hold said sleeve valve open so long as said safety valve is in operating position in said tubing string.

4. A well safety valve system in accordance with claim 3 wherein said means for holding said sleeve valve open is a sleeve shifter including said operating key selectively and releasably engageable with said sleeve valve.

5. A well safety valve system in accordance with claim 4 wherein said sleeve shifter is adapted to engage said sleeve valve for holding said sleeve valve open when said safety valve is in operating position relative to said sleeve valve and for moving said sleeve valve to closed position responsive to removal of said safety valve from operating relation with said sleeve valve.

6. A well safety valve system in accordance with claim 5 wherein said means for locking said safety valve and said sleeve shifter are connected with said safety valve to provide a tool train inserted into and removed from said tubing string by wireline tool methods.

7. A well safety valve system in accordance with claim 6 including external annular seals on said tool train spaced longitudinally to engage the inside wall surface of said housing for directing control fluid from said side port in said housing to said safety valve.

8. A tool train for use in a well safety valve system having a sliding sleeve valve provided with flow passage means for communicating a control fluid pressure into a tubing string, said tool train comprising: a well safety valve for controlling flow through said tubing string responsive to control fluid pressure communicated to said safety valve through said flow passage means of said sliding sleeve valve; means including single element operating key means connected with said safety valve for selectively engaging said sleeve valve for holding said sliding sleeve valve flow passage means open when said safety valve is in operating position in communication with said sleeve valve and closing said sliding sleeve valve when said safety valve is removed from said sliding sleeve valve, said means including a shoulder for opening said sliding sleeve valve and a shoulder for closing said sliding sleeve valve; and locking mandrel means coupled with said safety valve for releasably locking said safety valve in said tubing string in communication with said flow passage means of said sliding sleeve valve.

9. A tool train for a well safety valve system in accordance with claim 8 wherein said means for holding said sleeve valve open comprises a sleeve valve shifting device wherein said key means comprises selective sleeve shifting keys adapted to expand and contract for engagement with said sliding sleeve valve.

10. A tool train for a well safety valve system in accordance with claim 9 wherein said safety valve includes a ball valve type flow control member.

11. A tool train for a well safety valve system in accordance with claim 9 wherein said safety valve includes a poppet type flow control member.

12. A tool train for a well safety valve system in accordance with claim 9 wherein said safety valve includes a flapper type flow control member.

13. A tool train for use in a well safety valve system having a sliding sleeve valve provided with flow passage means for communicating a control fluid pressure into a tubing string, said tool train comprising: a well safety valve for controlling flow through said tubing string responsive to control fluid pressure communicated to said safety valve through said flow passage means of said sliding sleeve valve; locking mandrel means coupled with said safety valve for releasably locking said safety valve in said tubing string in communication with said flow passage means of said sliding sleeve valve; and means connected with said safety valve for selectively engaging and holding said sliding sleeve valve open when said safety valve is in operating position in communication with said sleeve valve flow passage means and for closing said sleeve valve when said safety valve is removed from said sleeve valve, said means for engaging and holding said sleeve valve including a tubular body mandrel; an outer sleeve secured in concentric spaced relation around said body mandrel, said sleeve having oppositely disposed side slots opening through one end of said sleeve and guide windows between said side slots, said guide windows having a wide first end and a narrow second end; an inner sleeve having one end portion positioned within said outer sleeve between said outer sleeve and said body mandrel, said inner sleeve having outwardly opening side pockets each aligned and connecting with one of said side slots of said outer sleeve, and said inner sleeve having retainer fingers along a second end portion projecting into said side pockets toward said first end portion of said sleeve; a selective sleeve valve engaging and operating key for expanding into locked relationship with said sleeve valve, said key being disposed for radial expansion and contraction in each one of said connecting side pockets and slots of said inner and outer sleeves, said keys each having a shoulder for opening said sliding sleeve valve and a shoulder for closing said sliding sleeve valve, said keys each having ear portions at one end thereof engaged in said guide windows of said outer sleeve and the other ends of said keys having recesses engageable with said retainer fingers at said second end of said inner sleeve, said keys being movable longitudinally relative to said outer sleeve and said body mandrel with said inner sleeve shifting said ears on said keys from said first wide ends of said guide windows to said second narrow ends of said guide slot for contracting said first ends of said keys radially inwardly to release said keys from a sliding sleeve valve; means between said keys and said body mandrel for biasing said keys radially outwardly; and holding means between said outer and inner sleeves connecting said sleeves together for retaining said inner sleeve at a first position relative to said outer sleeve at which said keys are movable only radially, said holding means being releasable when a force in excess of a predetermined value is applied to said keys toward said second end of said inner sleeve whereby said keys are moved with said inner sleeve away from said first end of said outer sleeve and said ears on said first end of said keys are moved into said narrow portions of said guide windows of said outer sleeve for contracting said keys inwardly along said first end portions of said keys for release of said keys from a valve member of a sliding sleeve valve.

14. A well safety valve system comprising: a tubular housing connectible into a well tubing string to form an integral portion of said well tubing string, said housing having a side port for communication into said string from exterior thereof; a sliding sleeve valve having a side port therein longitudinally movable in said housing between an upper closed position and a lower open position to control communication into said housing through said side ports; means defining a landing nipple formed in said housing above said sliding sleeve valve; and a tool train releasably lockable in said tubing string at said housing including a locking mandrel operable by wireline apparatus and releasably engageable at said landing nipple at said housing for supporting said tool train in said tubing string, a sleeve valve shifting device connected with said locking mandrel for selectively engaging and operating said sleeve valve responsive to movement of said tool train in said tubing string, said shifting device having a one piece sleeve engaging key provided with a shoulder to open said sleeve valve and a shoulder to close said sleeve valve, and a safety valve connected with said sleeve valve shifting device controlling flow through said tubing string responsive to a control fluid pressure communicated to said safety valve through said sleeve valve, said locking mandrel, said sleeve shifting device, and said safety valve being longitudinally spaced along said tool train to support said safety valve in communication with said sliding sleeve valve side port only when said sleeve shifting device is engaged with said sliding sleeve valve and holding said sliding sleeve valve open, and packing means on said tool train longitudinally spaced to engage the inner wall surface of said housing for sealing above and below said side port to direct control fluid to said safety valve when said tool train is locked in operating position at said housing.

15. In a well safety valve system having a housing having a side port and forming an integral part of a well tubing string and a sliding sleeve valve in said housing and having a side port for admitting control fluid from around said housing through said side ports, a tool train comprising: a locking mandrel operable by wireline apparatus and releasably engageable at a landing nipple at said housing for supporting said tool train in said tubing string, a sleeve valve shifting device connected with said locking mandrel for selectively engaging and operating said sleeve valve responsive to movement of said tool train in said tubing string, said sleeve shifting device having one piece sleeve engaging element means provided with a shoulder for opening said sleeve valve and a shoulder for closing said sleeve valve and a safety valve connected with said sleeve valve shifting device for controlling flow through said tubing string responsive to a control fluid pressure communicated to said safety valve through said sleeve valve, said locking mandrel, said sleeve shifting device, and said safety valve being longitudinally spaced along said tool train to support said safety valve in communication with said sliding sleeve valve side port only when said sleeve shifting device is engaged with said sliding sleeve valve and holding said sliding sleeve valve open, and packing means on said tool train longitudinally spaced to engage the inner wall surface of said housing for sealing above and below said side port to direct control fluid to said safety valve when said tool train is locked in operating position at said housing.

16. A tool train in a well system in accordance with claim 15 wherein said sleeve engaging element means includes sleeve shifting device keys wherein said shoulder for opening said sleeve valve and said shoulder for closing said sleeve valve comprise downshifting and upshifting shoulders thereon.

* * * * *

UNITED STATES PATENT OFFICE

CERTIFICATE OF CORRECTION

Patent No. 3,990,511 Dated November 9, 1976

Inventor(s) Imre I. Gazda

It is certified that error appears in the above-identified patent and that said Letters Patent are hereby corrected as shown below:

Column 1, line 22, cancel "into" and insert -- the --.
line 24, "To" should read "No".
Column 2, line 38, "this" should read "the".
Column 3, line 16, "vent" should read "event".
Column 6, line 30, "shaped" should read "shape".
Column 9, lines 25 - 26, cancel "shown at the lower end of Fig. 2D and in Fig. 2D is standard".
Column 10, line 25, "production" should read "producing".
Column 12, line 25, "upward" should read "upwardly".

Signed and Sealed this

Eleventh Day of January 1977

[SEAL]

*Attest:*

RUTH C. MASON
*Attesting Officer*

C. MARSHALL DANN
*Commissioner of Patents and Trademarks*